US005509289A

United States Patent [19]

Narragon

[11] Patent Number: 5,509,289

[45] Date of Patent: Apr. 23, 1996

[54] PORTABLE VEHICLE FRAME STRAIGHTENING APPARATUS

[76] Inventor: Steven L. Narragon, 1016 SW. Litchfield Ave., Willmar, Minn. 56201

[21] Appl. No.: 143,483

[22] Filed: Oct. 26, 1993

[51] Int. Cl.[6] ..... B21D 1/12

[52] U.S. Cl. ..... 72/305; 72/705

[58] Field of Search ..... 72/705, 456, 305

[56] References Cited

U.S. PATENT DOCUMENTS

| | | | |
|---|---|---|---|
| 3,566,666 | 3/1971 | Berendt et al. | 72/705 |
| 4,158,303 | 6/1979 | Horn et al. | 72/457 |
| 4,463,937 | 8/1984 | Celette | 72/705 |
| 4,573,337 | 3/1986 | Papesh | 72/705 |
| 4,694,674 | 9/1987 | Lawrence | 72/705 |
| 4,745,791 | 5/1988 | Fish | 72/705 |
| 5,031,438 | 7/1991 | Flannery | 72/305 |

FOREIGN PATENT DOCUMENTS

| | | | |
|---|---|---|---|
| 1514448 | 10/1989 | U.S.S.R. | 72/705 |

*Primary Examiner*—Lowell A. Larson
*Attorney, Agent, or Firm*—David George Johnson

[57] ABSTRACT

A portable frame straightening apparatus for straightening and repairing vehicles which is comprised of a frame structure (1) to which the damaged vehicle (124) is attached. The structure (1) is bolted to a plate (21) which is anchored to the floor. The frame structure (1) and the attached damaged vehicle (124) can be rotated to achieve the desired angle of pull needed to repair the damage. The structure (1) is then secured to the floor with a chain (214) on either side which are fastened to anchors (216) in the floor so as to prevent rotation of the structure (1) while pulling. An independently standing pulling tower (213) which is also rotatable in a similar fashion to the plate (21) can accommodate various vertical adjustments for height variation as needed in pulling on the damaged vehicle. By removing the center bolt (107) which holds the frame structure (1) to the plate (21) that is anchored in the floor, the assembly (1) can easily be loaded on a cart (270) and moved to clear the floor space for other types of work.

7 Claims, 15 Drawing Sheets

PORTABLE VEHICLE FRAME STRAIGHTENING APPARATUS

BACKGROUND OF THE INVENTION

1. Field of the Invention

This invention relates generally to the field of automobile repair devices, and more particularly to a portable apparatus suitable for straightening or realigning the metal frame of a motor vehicle that has been involved in an accident.

2. Related Technology

The frame of an automobile that has been involved in a collision often undergoes plastic deformations. The vehicle cannot be operated safely unless these plastic deformations are removed and the vehicle frame returned to its original configuration. The realignment of the vehicle frame must be performed with a high degree of accuracy.

The state of the art method of straightening a vehicle frame involves securely anchoring the damaged vehicle and pulling the frame in a direction such that the vehicle frame is returned to its original configuration. The amount of force required must exceed the yield strength of the frame material, which is typically composed of a steel alloy. The tensile force is usually applied by means of a chain which is ultimately connected to a hydraulic cylinder capable of supplying the required force.

The damage to a vehicle frame can occur in any of a wide variety of magnitudes and orientations, and does not follow any set pattern. In order to correct the irregular damage actually encountered, the vehicle frame must be repeatedly pulled with varying amounts of force following many different vector paths. These numerous pulling operations are performed sequentially, and require that either the vehicle or the actual pulling mechanism be repeatedly repositioned as the frame straightening process progresses.

The repositioning steps consume a large portion of the time required to complete the overall frame repair. The vehicle frame apparatus must be quite sturdy in order to securely anchor the vehicle during the repeated pulling events. The typical frame straightening device usually includes some type of tower or standard which supports one end of a chain at some distance above the vehicle. Since some pulling vectors have a substantial vertical component, the tower should support its end of the chain at an elevation that is as high as possible. The other end of the chain is attached to the vehicle frame, and a hydraulic cylinder pulls the chain towards the tower. Ideally, this entire structure should be as sturdy, and hence massive, as possible.

However, many facilities in which frame straightening is performed do not have a sufficient volume of vehicle frame straightening work to justify dedicating an exclusive workspace, such as a garage bay, to this task. Thus, the frame straightening device should also be as small and portable as possible to facilitate its frequent manipulation during the frame straightening process as well as its removal from the area after the process is completed.

Some frame straightening devices secure the vehicle by anchoring the vehicle to a concrete floor. The vehicle perimeter is surrounded by a large number of anchors which can also support the pulling tower. As different pulling vectors are required, the tower can be moved to the nearest anchor position that approximates the desired azimuthal position. Such a system requires drilling a large number of permanent anchor sites into the concrete floor. The specific floor area adjacent to the anchor sites must be cleared whenever the frame straightening operation is to be performed. Since the number of anchor sites is finite, the number of pulls required to straighten the frame is increased, because two or more pulls are required to achieve the intermediate angle actually needed.

Other frame straightening devices have pulling standards that are connected to a work rack upon which the vehicle is secured. The standards are movable around the periphery of the work rack to provide various pulling angles. This type of device is generally large and quite massive. These devices are difficult to move, and usually remain permanently stationed in a certain area of designated floorspace.

Another solution is to mount a pivoting work rack onto a base frame. The pulling tower is mounted onto the base frame, and the work rack is rotated so as to provide the appropriate vectorial relationship between the vehicle frame and the tower. An example of such a device is disclosed in U.S. Pat. No. 5,031,438. The anchoring mechanism disclosed is limited to four portable jacks, which rely largely on the weight of the vehicle and the turntable itself to secure the turntable in place. Unless the chain is acting exactly along a diameter of the turntable, the turntable will tend to rotate when the pulling force exceeds the frictional force provided by the four jacks. This rotation is resisted only by a single longitudinal member and pin, which in practice can deflect or even break under the substantial loads imposed during a typical pulling operation. In order to rotate the turntable to a new position, all four jacks will frequently need to be raised through the substantial distance needed to clear the base member.

Another similar device is disclosed in U.S. Pat. No. 4,158,303, which includes a rotatable framework upon which the vehicle is mounted. In this device, the pulling tower is permanently interconnected to the base upon which the turntable is mounted. In order to anchor the entire structure, massive steel beams rest upon, but are not otherwise anchored to, the floor. While this may achieve the necessary stability required during pulling operations, the large mass of the device destroys its portability. Additionally, the rigid and permanent interconnection of the pulling tower to the base structure limits the absolute size of the frame which may be mounted on the turntable while still preserving its ability to rotate through a complete three hundred sixty degree arc.

The rotatable vehicle supports just described, as well as others, have not found wide acceptance in the industry because they are either to lightweight, too small, not portable and simply not versatile enough to satisfy the various demands placed on them in the course of operating an actual vehicle frame straightening business.

SUMMARY OF THE INVENTION

The present invention includes a frame straightening apparatus which provides a means for rotating the damaged vehicle to permit any desired azimuthal orientation with respect to a pulling tower. The vehicle may be chained in most cases, and thereby secured, in the desired position with only one anchor on either side of the vehicle. This allows a fast and easy change in angles with a complete selection of all intermediate angles within the entire three hundred sixty degree range. The need for numerous permanently mounted anchors surrounding the vehicle is thereby eliminated. The pulling tower is also rotatable to allow for a direct alignment angle for any direction of pull required.

The rotating vehicle supporting framework of the present invention rotates on a single bolt or shaft which can be removed quickly. This permits the disassembly of the entire device, which can then be loaded onto a cart and removed from the work area, thereby freeing that space for other types of work. The pulling tower or standard, which is a separate, discrete component not connected to the vehicle support framework, is also readily movable upon its own wheels without reliance upon a cart.

A repair operation can be performed on, for example, the front portion of the vehicle and then on the rear portion of the vehicle without the need to unclamp the vehicle from the work rack, turn the vehicle around, and then reclamp the vehicle to the supporting framework.

The present invention requires only four to six anchors to be permanently mounted in the floor, depending on whether one, two or three pulling standards are used. This is in contrast to other floor mounted frame straightening systems which require as many as forty anchors, further requiring that the pulling standard be moved each time a different angle of pull is required.

DETAILED DESCRIPTION OF THE PREFERRED EMBODIMENTS

Figure 1:
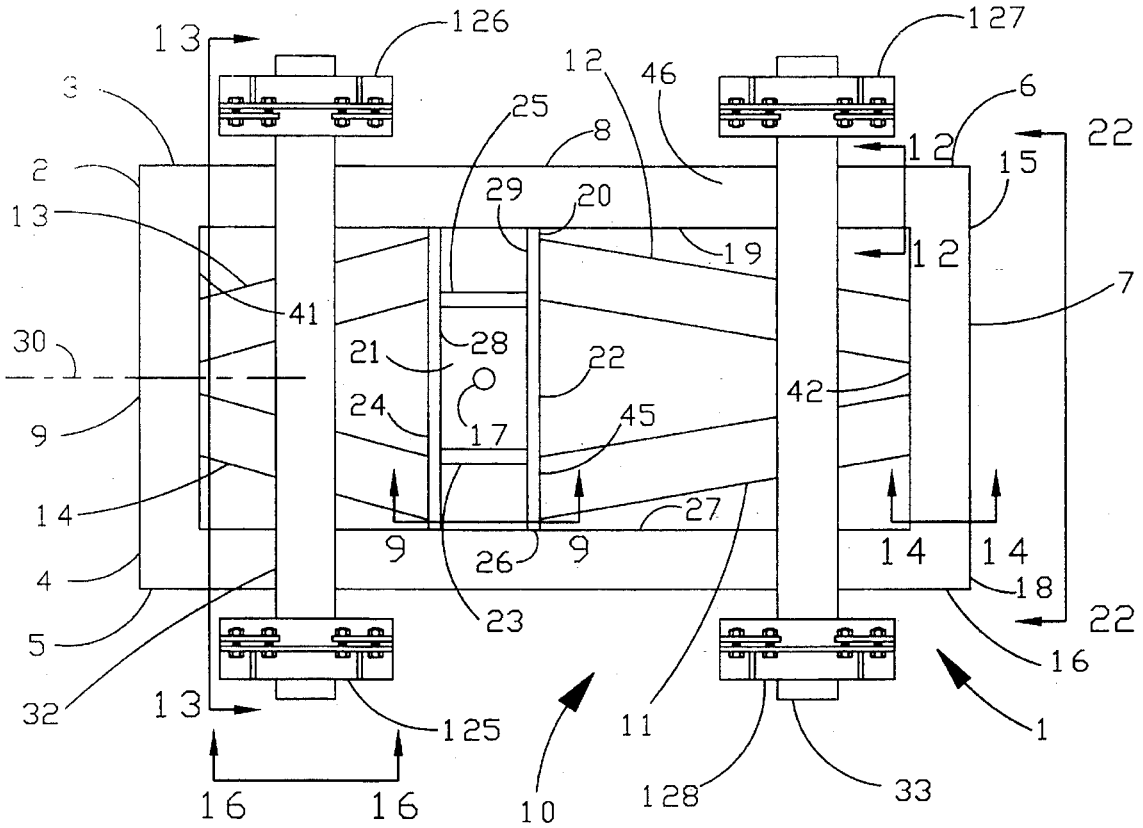
FIG. 1 is a top plan view of a vehicle frame supporting structure constructed in accordance with the principles of the present invention.

Referring to FIG. 1, a vehicle frame support structure constructed according to the principles of the present invention is shown generally at 1. The support structure 1 is constructed in a generally rectangular configuration formed by joining the first end 2 of first beam 9 to the first end 3 of second beam 8, while the second end 4 of first beam 9 is rigidly affixed to first end 5 of third beam 10. The basic support structure 1 is completed by attaching the second end 6 of second beam 8 to the first end 15 of fourth beam 7 and attaching the second end 16 of third beam 10 to the second end 18 of fourth beam 7. Attachment may be by any suitable means that will provide a relatively inflexible joint, such as by welding or riveting. In a preferred embodiment, the beams 7,8,9 and 10 are composed substantially of a steel alloy.

Welded to the inner surface 19 of second beam 8 is a first end 20 of first lateral channel 22, the first end 20 being at or near the midpoint of second beam 8. The second end 26 of lateral channel 22 is welded to the approximate midpoint of the inner surface 27 of third beam 10. Displaced approximately one foot from lateral channel 22 is a second lateral channel 24, which is welded to the inner surfaces 19 and 27 so as to form a substantially parallel relationship to lateral channel 22.

Longitudinal channels 23 and 25 are welded to the inside surfaces 28 and 29 of channels 24 and 22, respectively, the channels 23 and 25 being in a substantially parallel relationship approximately eighteen inches apart. The channels 23 and 25 are substantially equidistant from the longitudinal axis 30 of support structure 1.

Figure 10:
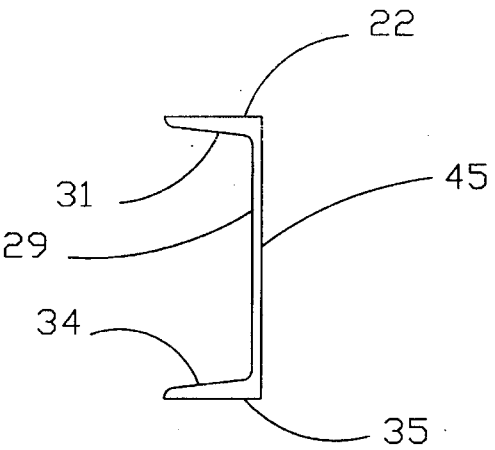
FIG. 10 is a side elevation of a channel as depicted in FIG. 9.
Figure 9:
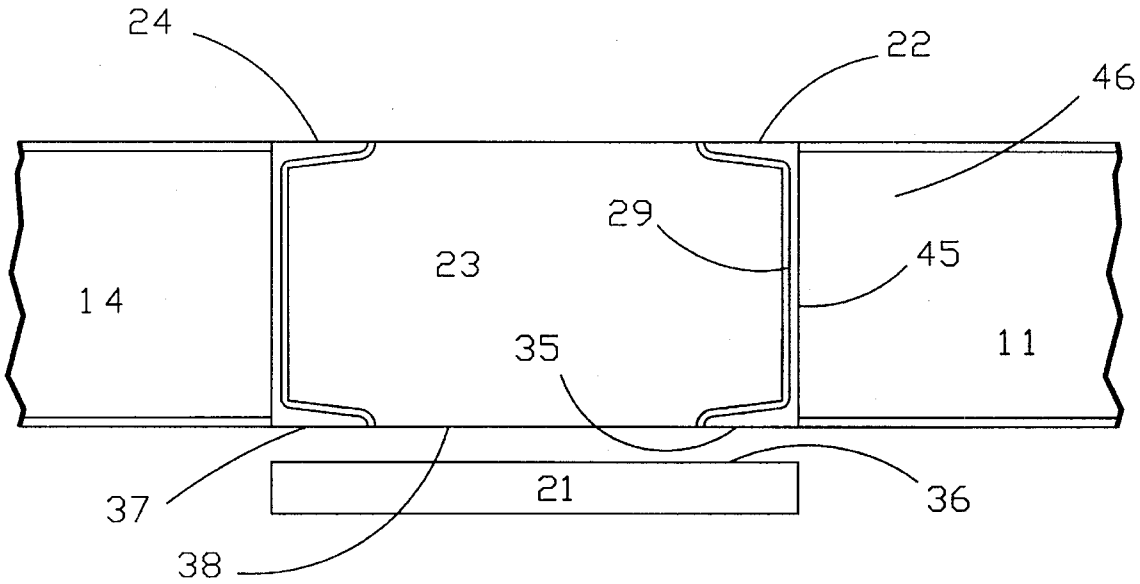
FIG. 9 is a sectional view of the vehicle frame supporting structure taken along line C—C of FIG. 1.
Figure 12:
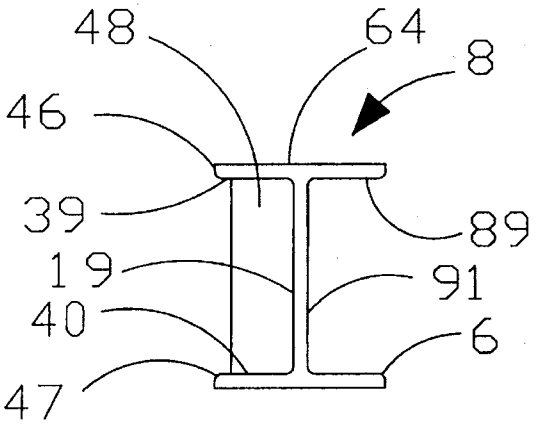
FIG. 12 is a sectional view taken along line D—D of FIG. 1.
Figure 11:
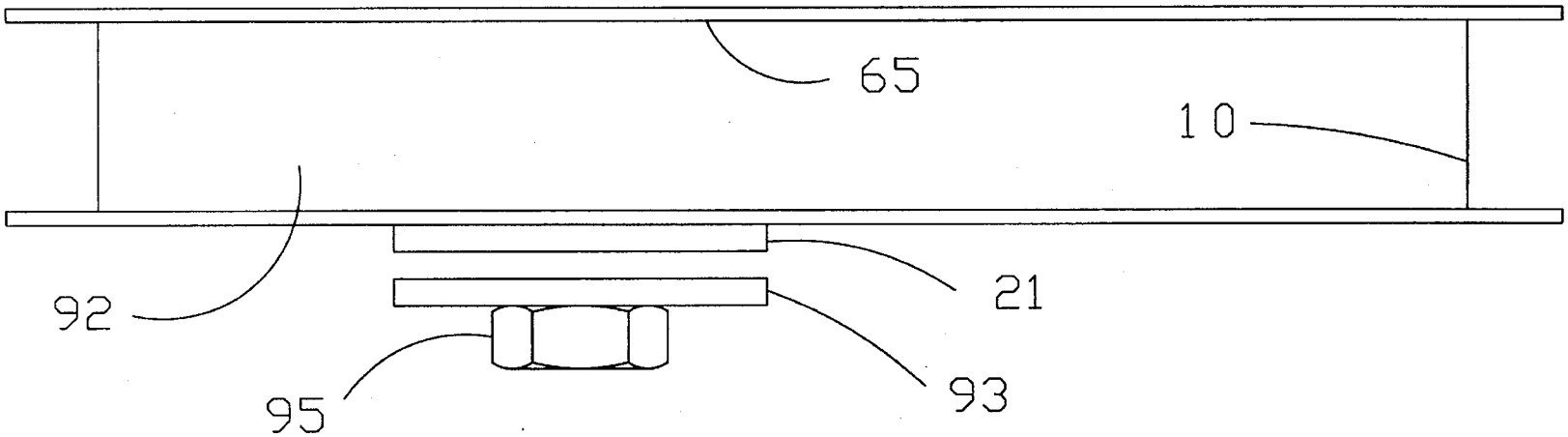
FIG. 11 is a side elevation depicting the relationship between the vehicle frame supporting structure and the base mounting plate.

Referring to FIGS. 9 and 10, longitudinal channel 23 can be seen to be welded to surfaces 29, 31, and 34 of lateral channel 22, with a similar arrangement used (not shown) for lateral channel 24. The bottom surface 35 of channel 22 is welded to the top surface 36 of plate 21, as is the bottom surface 37 of channel 24, the bottom surface 38 of channel 23 and the bottom surface (not shown) of channel 25. Referring to FIG. 12, one can see that end 20 of channel 22 is welded to the inside surfaces 19, 39 and 40 of beam 8. The opposite end 26 of beam 22 is welded in a similar fashion (not shown) to the inner surface 27 of beam 10. Lateral channel 24 is welded in a similar manner (not shown) to beams 8 and 10 as just described for lateral channel 22.

Figure 14:
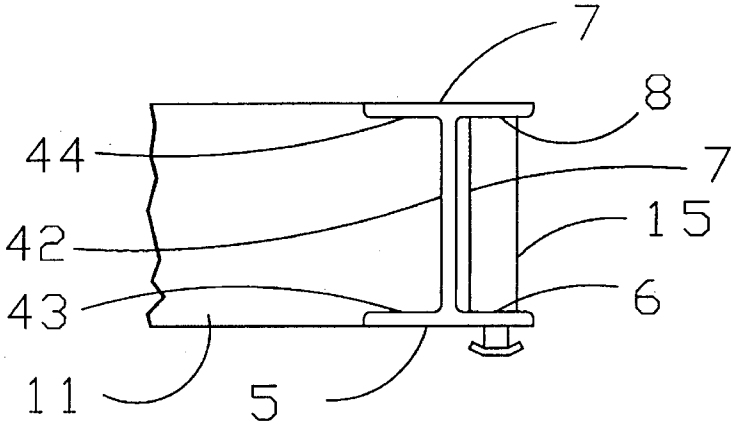
FIG. 14 is a sectional view taken along line F—F of FIG. 1.
Figure 13:
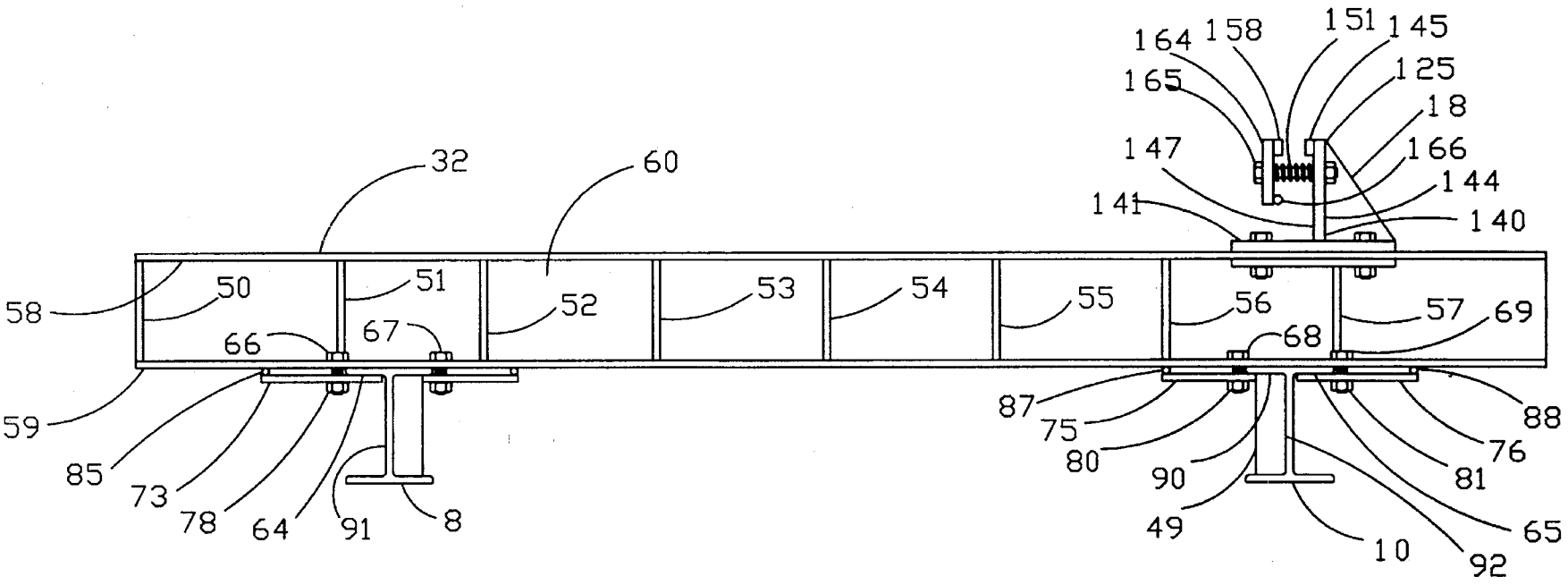
FIG. 13 is a sectional view taken along line E—E of FIG. 1.
Figure 17:
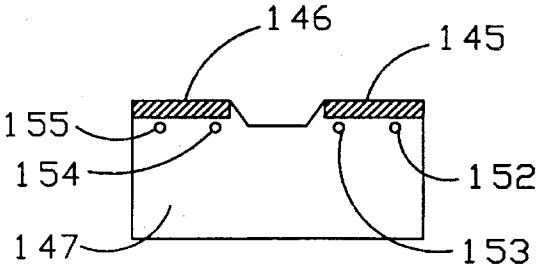
FIG. 17 is a side elevation of a first vehicle clamp plate constructed in accordance with the principles of the present invention.
Figure 19:
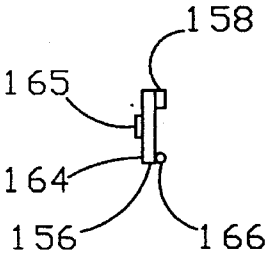
FIG. 19 is an end elevation of the second vehicle clamp plate depicted in FIG. 18.
Figure 15:
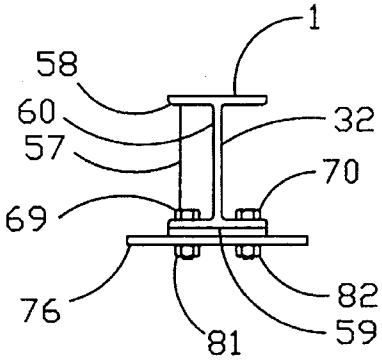
FIG. 15 is a sectional view taken along line G—G of FIG. 1.
Figure 18:
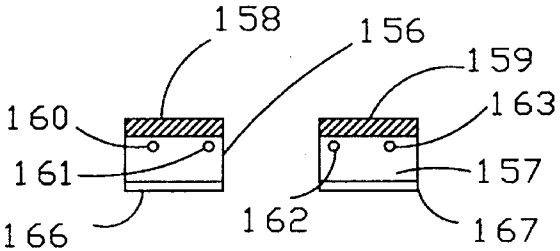
FIG. 18 is a side elevation of second and third vehicle clamp plates constructed in accordance with the principles of the present invention.
Figure 16:
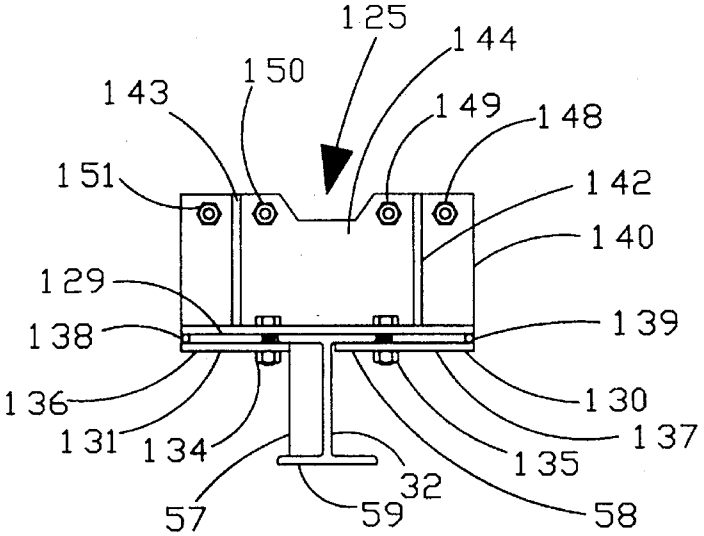
FIG. 16 is an end elevation of a vehicle clamp support beam constructed in accordance with the principles of the present invention.

Reinforcement beams 11, 12, 13 and 14 are welded to the inside surfaces 41 and 42 of beams 9 and 7, respectively. Referring to FIG. 14, reinforcement beam 11 is seen to be welded to beam 7 at surfaces 42, 43 and 44. As shown in FIGS. 1 and 9, the outer surface 45 of beam 22 is welded to end 46 of beam 11. Further reinforcement of the top flange 46 and bottom flange 47 of beam 8, as seen in FIGS. 12 and 13, is provided by a series of flat plates, such as plates 48 and 49, welded to surfaces 19, 39 and 40 of beam 8. Other plates, such as plate 49, are welded in similar fashion to longitudinal beam 10.

As can be seen in FIGS. 1, 2, 13 and 15, the framework formed by beams 8, 9, 10 and 11 and the associated channels 22, 23, 24 and 25, as well as reinforcing beams 11, 12, 13 and 14, supports vehicle clamp support beams 32 and 33. Beams 32 and 33 include a series of flange stiffening elements 50, 51, 52, 53, 54, 55, 56 and 57 extending between upper flange 58 and lower flange 59 and abutting outer surface 60. A similar series of stiffeners, such as stiffener 61, are welded between upper flange 62 and lower flange 63 of support beam 33.

The bottom flange 59 of support beam 32 contains a series of eight holes, four overlying matching holes in longitudinal beam 8 and four overlying matching holes in beam 10. These holes are separated and arranged so as to reside outside of the area occupied by the upper flanges 64 and 65 of beams 8 and 10, respectively. The holes are suitably dimensioned to accept one each of eight bolts, of which bolts 66, 67, 68, 69 and 70 are shown. The bottom flange 63 of beam 33 also contains eight holes for the acceptance of eight bolts, of which bolts 71 and 72 are visible in FIG. 2.

The bolts just described are used to secure eight plates, of which plates 73, 74, 75, 76 and 77 are visible, to the underlying beams 8 and 10. In particular, plates 73 and 74 grip upper flange 64 of beam 8 while plates 75 and 76 grip upper flange 65 of beam 10. Plate 77 grips one side of upper flange 65 of beam 10. Welded to the underside of each plate are two nuts, for example nuts 78, 79, 80, 81, 82, 83 and 84, into which the bolts are threaded. Metal rods, such as, for example rods 85, 86, 87 and 88 are welded to the upper sides of the plates 73–77, as well as the three plates that are not visible, in order to fill a space equal to the thickness of upper flanges 64 and 65 so that the plates are parallel to the lower surfaces 89 and 90 of flanges 64 and 65, respectively, when the bolts 66–72 are fully tightened. The inner plates 74 and 75 are narrower than the outer plates 73 and 76 in order to allow clearance for stiffeners 48 and 49. The outer plates 73 and 76 have a length sufficient to permit abutting contact with webs 91 and 92, respectively. The arrangement just described is typical for each of the four locations at which support beams 32 and 33 contact the surfaces of longitudinal beams 8 and 10. This method of securing beams 32 and 33 to beams 8 and 10 allows forward and rearward adjustment of beams 32 and 33 in order to accommodate vehicles of different lengths.

As has already been discussed and as can be seen in FIG. 1, a plate 21 is supported between channels 22, 23, 24 and 25. Centrally located within plate 21 is a hole 17, through which is mounted some sort of spindle or post in order to permit rotation of the entire assembly 1. The actual base plate assembly which incorporates the spindle can take numerous forms, of which two preferred embodiments will be described here. Referring to FIGS. 3, 4, 5, 6 and 11, a steel base plate 93 is shown formed in a substantially circular shape with a hole 94 formed in the center. A threaded nut 95 is welded to the bottom surface 96 of plate 93 with countersunk holes 97, 98, 99, 100, 101 and 102 spaced at approximately the halfway point on six equally spaced radii. In use, concrete anchors (not shown) are installed through each of the holes into a suitable surface, such as a concrete floor (not shown). The concrete anchors are fastened to the plate 93 by means of a washer and nut placed in each of the holes 97–102, such as, for example, by washer 103 and nut 104. This arrangement permits lower surface 96 of plate 93 to be flat and snug against the floor (not shown) while the upper surface 105 is flat and presents no raised obstructions, such as bolt heads. A spacer pipe 106 is placed through hole 17 of plate 21, with the bottom surface 108 of spacer 106 resting on top of washer 109. A bolt 107 passes sequentially through plate 21, spacer 106, washer 109, plate 93 and is threaded into nut 95. This arrangement permits rotation of plate 21 about bolt 107.

Figure 7:
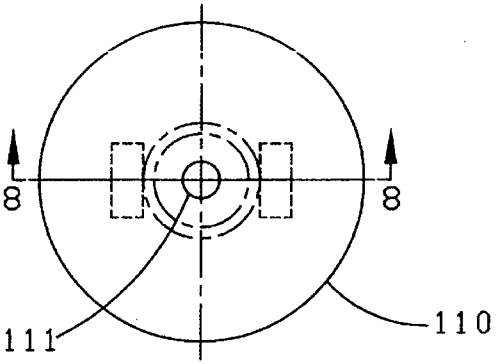
FIG. 7 is a top plan view of a second embodiment of a base plate constructed in accordance with the principles of the present invention.
Figure 8:
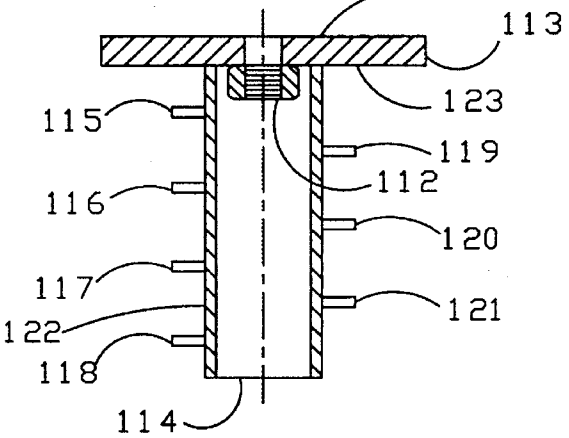
FIG. 8 is a sectional view taken along line B—B of FIG. 7.
Figure 3:
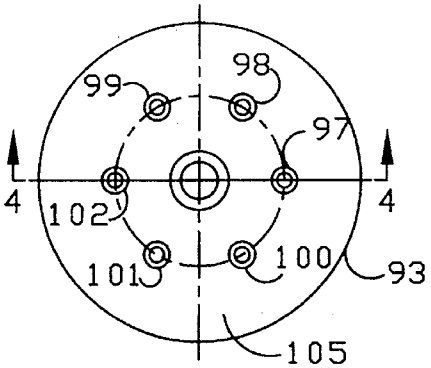
FIG. 3 is a top plan view of a first embodiment of a base mounting plate constructed in accordance with the principles of the present invention.

A second embodiment is shown in FIGS. 7 and 8, and includes a base plate 110 formed as a circular steel plate containing a centrally located hole 111. A threaded nut 112 welded to the bottom surface 113 of plate 110. A pipe 114 is also welded to the bottom surface 113 of plate 110, and includes metal tabs 115, 116, 117, 118, 119, 120 and 121 welded to the outer surface 122 of pipe 114. The tabs 115–121 anchor the assembly in concrete such that the lower surface 123 is flush with the concrete floor (not shown). This type of mounting arrangement is recommended in situations where the floor is quite porous and is composed of a lower grade of concrete.

Figure 2:
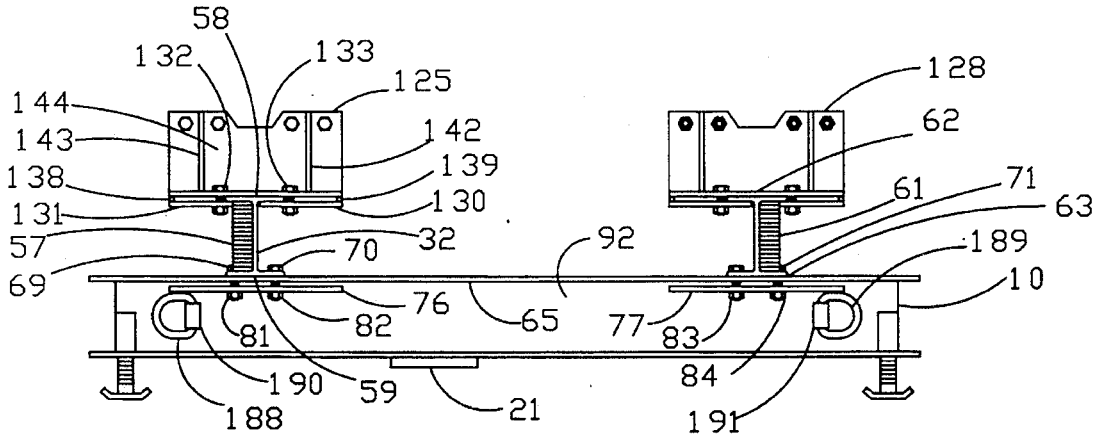
FIG. 2 is a left side elevation of the structure depicted in FIG. 1.
Figure 32:
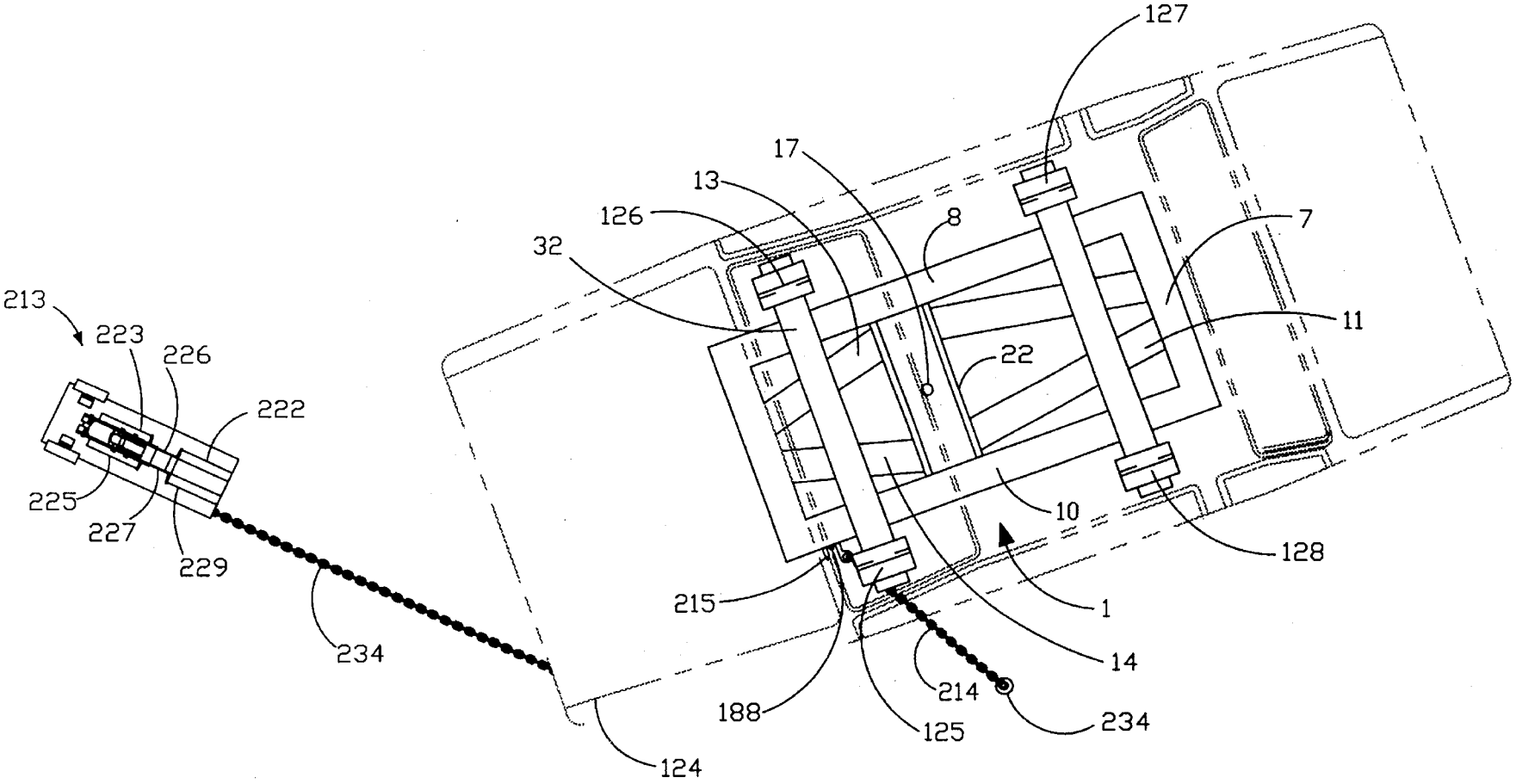
FIG. 32 is plan view depicting the present invention in a use position with the body of a motor vehicle depicted in phantom.
Figure 34:
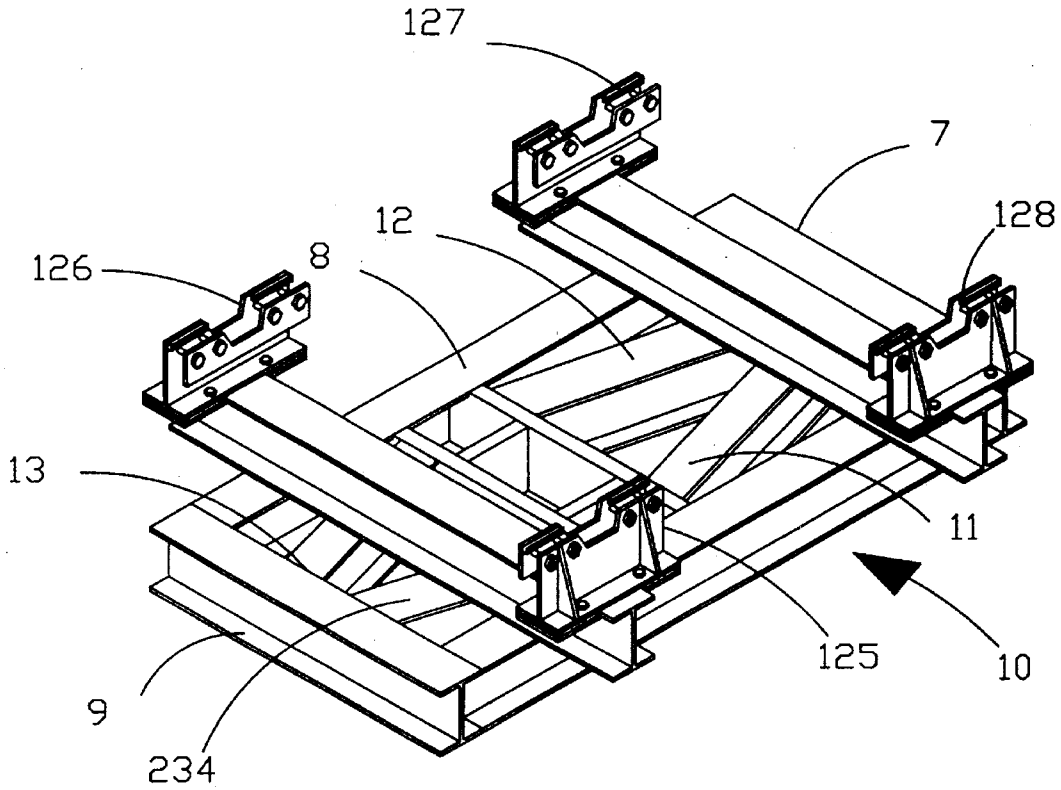
FIG. 34 is a perspective view of the vehicle frame supporting structure as depicted in FIG. 1.
Figure 33:
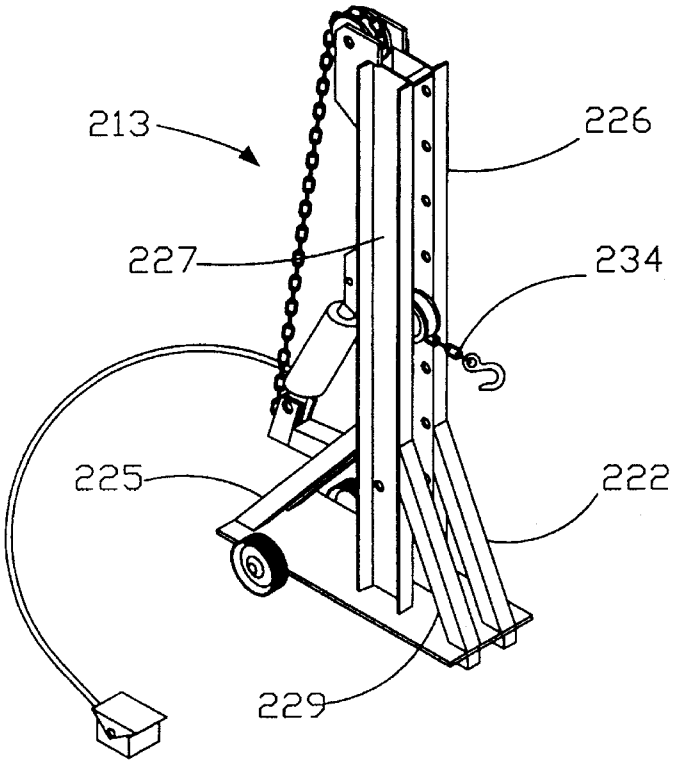
FIG. 33 is a perspective view of the pulling tower depicted in FIG. 24.

As can be seen in FIGS. 1, 2 and 32, a vehicle 124 can be mounted on the frame supporting assembly 1 by means of vehicle clamps 125, 126, 127 and 128. Each of these clamps is substantially identical, so only clamp 125 will be discussed in detail. Referring to FIGS. 13, 15, 16, 17, 18 and 19, clamp 125 is seen to include a flat plate 129 with two plates 130 and 131 with bolts 132 and 133 passing through plate 129, the bolts being threaded into nuts 134 and 135 which are welded onto the bottom sides 136 and 137 of the plates 130 and 131. This secures plate 129 to the upper flange 58 of support beam 32. Small metal rods 138 and 139, having the thickness of upper flange 58, are welded to the upper surfaces of plates 131 and 130, respectively, thereby preserving the parallel relationship of plates 130 and 131 with upper flange 58 after bolts 132 and 133 are tightened.

A flat plate 140 is welded to the upper surface 141 of plate 129 so as to form a perpendicular relationship. Two substantially triangular pieces of flat metal 142 and 143 are welded to outer surface 144 of plate 140 as well as to the upper surface 141 of plate 140, thereby tending to stabilize plate 140. First and second toothed bars 145 and 146 are welded to an upper region of inner surface 147 of plate 140.

A series of bolts 148, 149, 150 and 151 pass through holes 155, 154, 153 and 152, respectively, and mate with a pair of matching plates 156 and 157. Each plate 156 and 157 includes a toothed bar 158 and 159, respectively, as well as a pair of bolt holes 160 and 161 as well as holes 162 and 163, respectively. Bolt 148 passes through holes 155 and 163, bolt 149 passes through holes 154 and 162, bolt 150 passes through holes 153 and 161, and bolt 151 passes through holes 152 and 160. A nut 165 is welded to the outer surface 164 of plate 156, for example, and screws into bolt 151.

In use, the pinchweld seam (not shown) of an automobile 124 is clamped between toothed bars 145, 146, 158 and 159 and is held securely to the rest of the assembly 1 when the bolts 148–151 are tightened. Round steel rod 166 and 167 is welded to the bottom edge of plates 156 and 157, respectively, in order to hold the plates in a parallel relationship with plate 125 when bolts 148– 151 are tightened, thereby creating an equal distribution of pressure on the toothed bars while holding the vehicle.

The arrangement just discussed is found in four places on assembly 1, with two such configurations residing on beam 32 and two more residing on beam 33. These assemblies slide inwardly and outwardly on beams 32 and 33, thereby providing a means for accommodating vehicles of different widths.

Figure 21:
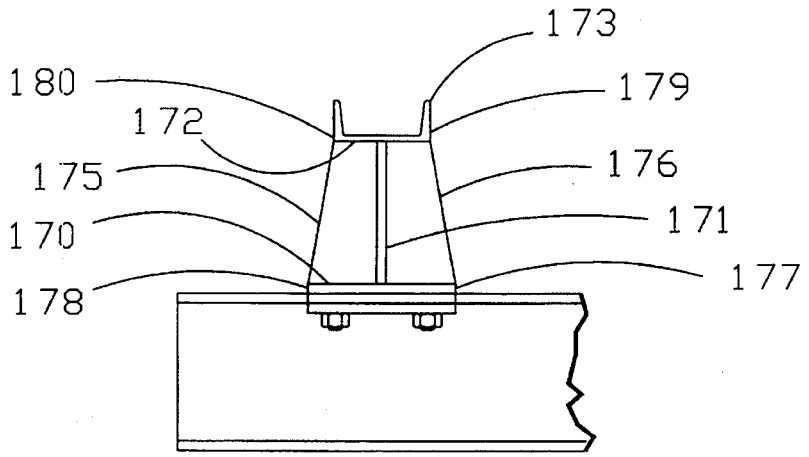
FIG. 21 is an end elevation of the vehicle clamp depicted in FIG. 20.
Figure 20:
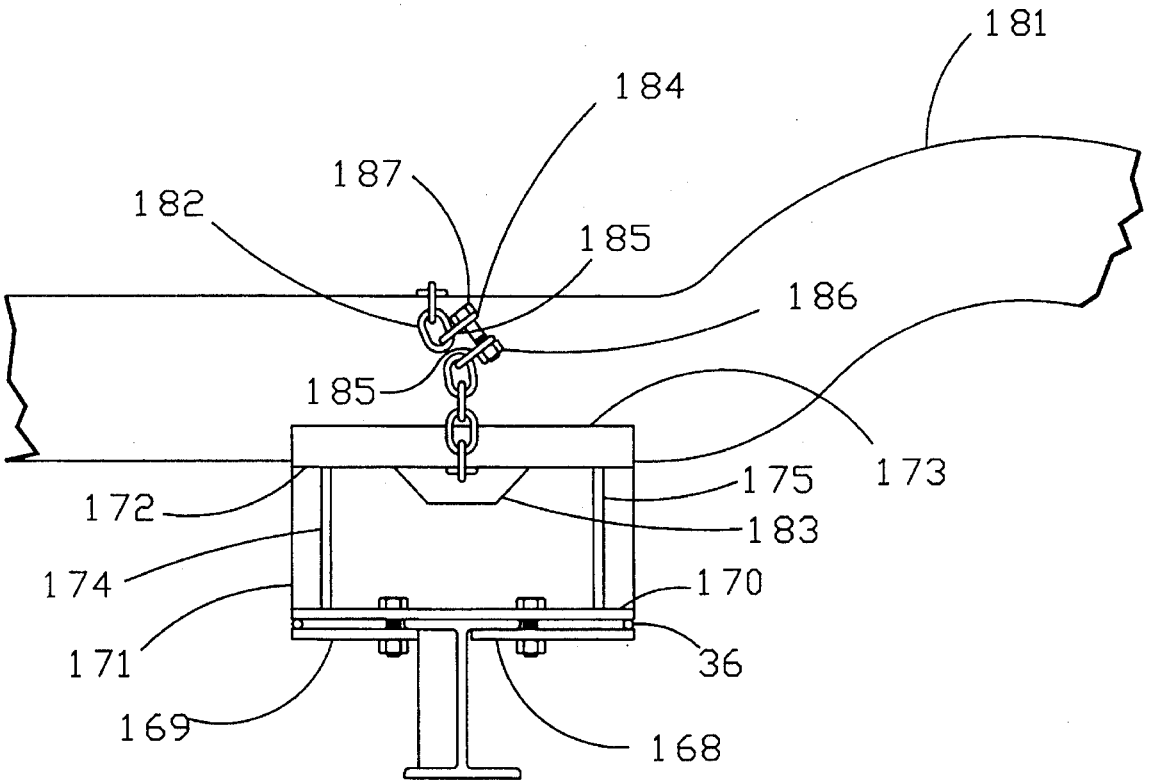
FIG. 20 is a side elevation of a vehicle clamp constructed in accordance with the principles of the present invention, showing the relationship between a vehicle frame and the vehicle clamp in a use position.

Referring now to FIGS. 20 and 21, a second type of clamp is depicted which may be used advantageously in order to secure a full frame vehicle. Plates 168, 169, 170 and 171 are substantially identical in form to the elements 130, 131, 141 and 140 just described for the pinchweld type of clamp 125, and they may be mounted on beams 32 and 33 in the manner described for clamp 125. However, the upper surface 172 of plate 171 is modified insofar as a channel 173 is welded to surface 172. Four stiffeners, two on either side of plate 171 and including stiffeners 174, 175 and 176, extend from the outer edges 177 and 178 of plate 170 to the outer edges 179 and 180, respectively, of channel 173. These stiffeners are welded to the bottom 181 of channel 173, the surface of plate 171, and to the top of plate 170, thereby stabilizing the channel 173 atop plate 171.

When the frame 181 of vehicle 124 is placed in clamps formed to include the channel 173, a chain 182, for example, is wrapped around the frame 181 as well as the channel 173, plate 171 being formed to include an orifice 183 beneath channel 173 so as to permit passage of the chain 182. The chain ends 184 and 185 are secured together by, for example, nut 186 and bolt 187. These assemblies including channel 173 can slide inwardly and outwardly along beams 32 and 33 in order to provide adjustment for different widths of a full frame vehicle.

Referring to FIGS. 2, 12 and 32, D-Rings 188 and 189 are seen to be secured to beam 10. Two more D-Rings (not shown) are affixed to longitudinal beam 8. The D-Rings 188 and 189 are formed from sections of steel rod by means of retaining members 190 and 191, respectively. The retaining member 190, for example, is formed from a flat piece of metal that is formed in a "U" shape, the ends of the "U" being welded to the beam 10. As seen in FIG. 12, the "U" shaped retaining member could preferably be welded to beam 8 at surface 91.

In use, the frame structure 1 and the vehicle 124 which is secured on assembly 1 are rotated to obtain the desired angle of pull on vehicle 124 and a chain 214 is looped via hook 215 through one of the two D-Rings on each of the beams 8 and 10. The other end of each chain 214 is hooked to a suitable chain anchor 216 located on either side of the vehicle. In this manner the vehicle 124 and assembly 1 are prevented from rotating while the actual pulling operation is performed. With this method, the assembly 1 can be held in any azimuthal orientation throughout a complete three hundred sixty degree arc by selecting the appropriate D-Ring to use and by hooking the chain tightly when the assembly 1 and the vehicle 124 have been rotated to the desired position.

Figure 22:
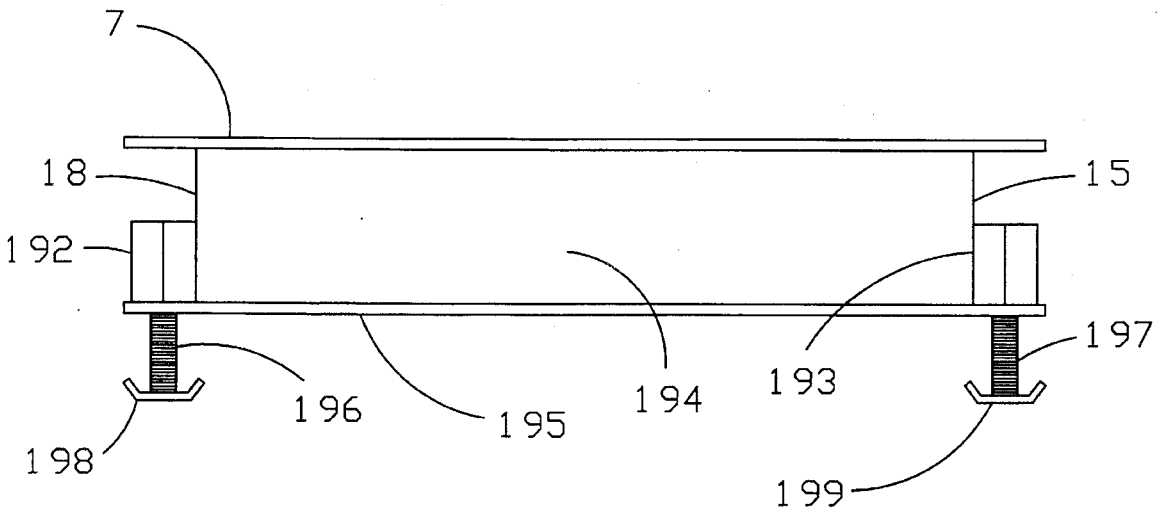
FIG. 22 is an end elevation of the vehicle frame supporting structure depicted in FIG. 1.
Figure 24:
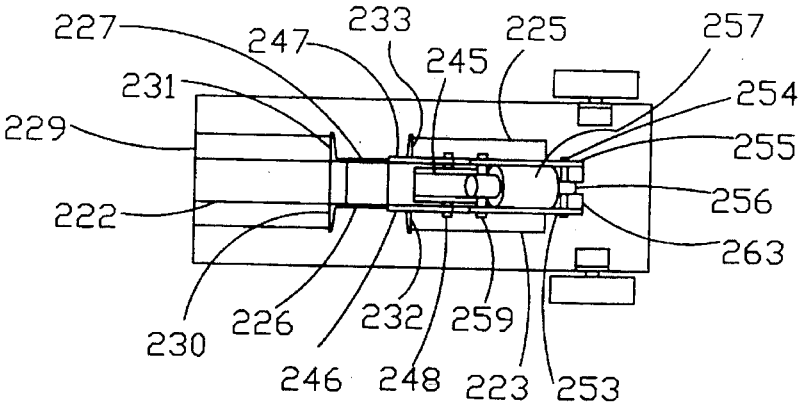
FIG. 24 is a plan view of a pulling tower constructed in accordance with the principles of the present invention.
Figure 25:
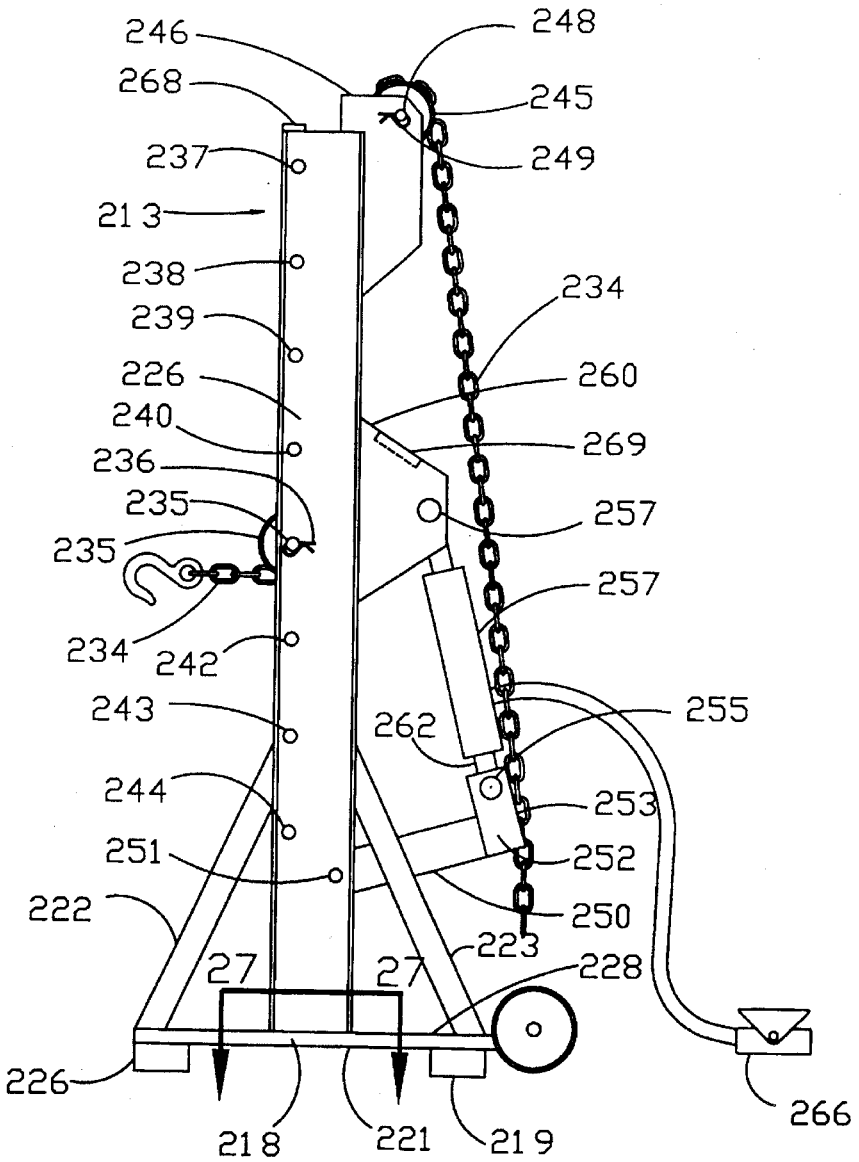
FIG. 25 is a side elevation of the pulling tower depicted in FIG. 24.

The frame assembly 1 may utilize various methods by which it is secured to the floor (not shown) while making a pull. FIG. 22 depicts an end view of assembly 1 showing lateral beam 7. Two nuts 192 and 193 are mounted, such as by welding, to the web 194 of beam 7 adjacent to ends 18 and 15, respectively, of beam 7. A hole (not shown) residing in the lower flange 195 beneath each nut 192 and 193 permits the threaded rods 196 and 197 to be inserted through the corresponding hole. Skid pads 198 and 199 are welded onto the bottoms of the rods 196 and 197, respectively. The threaded rods are adjusted to prevent assembly 1 from tilting during the pulling operation.

Figure 6:
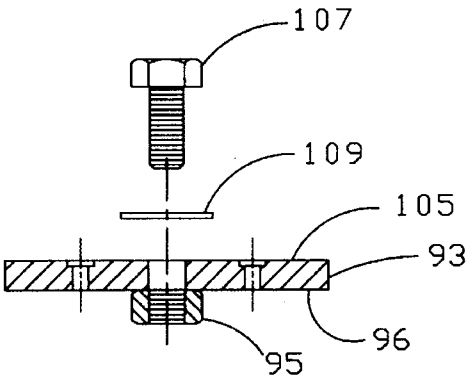
FIG. 6 is a side elevation of the base plate depicted in FIG. 5 with some fasteners depicted in expanded form.
Figure 23:
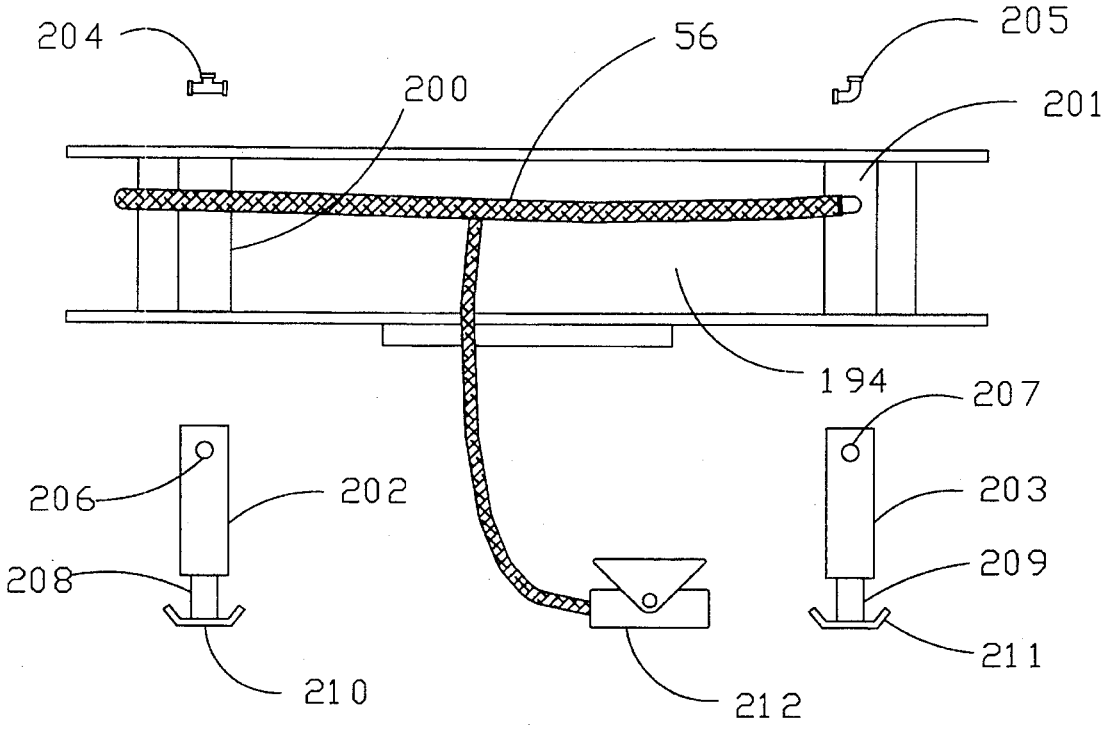
FIG. 23 is a schematic view of a second embodiment of a vehicle frame supporting structure constructed in accordance with the principles of the present invention.

An alternate method of securing the assembly 1 to the floor is illustrated in FIG. 23. Pipes 200 and 201 are welded onto flange 194 of beam 7 in place of nuts 192 and 193 as depicted in FIG. 6. Pipes 200 and 201 provide housings for cylinders 202 and 203, respectively. Hydraulic fittings 204 and 205 are inserted into holes (not shown) in the pipes 200 and 201 and screwed into holes 206 and 207 of cylinders 202 and 203, respectively, in order to hold the cylinders in place within each individual pipe. The bottom of each ram 208 and 209 of the cylinders 202 and 203 is fitted with a skid pad 210 and 211, respectively. Hydraulic pump 212 causes the rams 208 and 209 to extend to the floor (not shown) in order to stabilize the structure 1 on the floor when a pulling operation is being performed.

Figure 4:
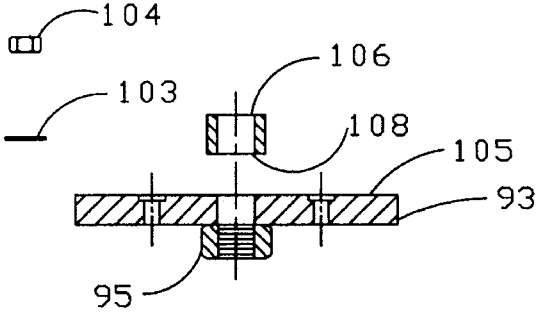
FIG. 4 is a sectional view taken along lines A—A of FIG. 3, with some fasteners depicted in expanded form.
Figure 5:
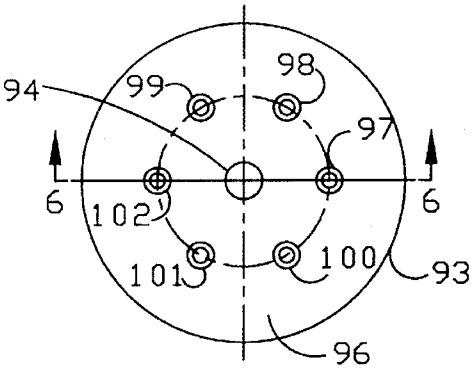
FIG. 5 is a bottom plan view of the base mounting plate depicted in FIG. 3.

Referring to FIGS. 5, 24, 25, 26, 27 and 28, the pulling tower 213 will now be discussed. The pulling tower includes a base plate 217, which is somewhat smaller in diameter than the base plate 93 discussed earlier, but which is otherwise substantially identical to base plate 93. The base of tower 213 is formed as a rectangular steel plate 218 which includes a hole to allow a spacer pipe and bolt, such as spacer pipe 106 and a bolt 107 as shown in FIGS. 4 and 6, to go through the hole and thereby secure plate 218 to base plate 217. Base plate 217 is anchored to the floor (not shown).

Four flat steel blocks, of which blocks 220, 224 and 219 are visible, are welded to the bottom surface 221 of base member 218 directly beneath support braces 222, 225 and 223, respectively, as well as support brace 229, to fill the gap between plate 218 and the floor (not shown) to stabilize the tower 213 and thereby prevent the tower from tilting while pressure is exerted during a pull.

Two channel irons 226 and 227 are welded to the top surface 228 of plate 218 and are reinforced by the square tubes 222, 223, 229 and 225. Tube 222 is welded to the front side 230 of channel 226, tube 229 is welded to the front side 231 of channel 231, tube 223 is welded to the rear side 232 of channel 226 and tube 225 is welded to the rear side 233 of channel 227. All of the tubes 222, 229, 225 and 233, as well as both channel irons 226 and 227 are welded to the top surface 228 of plate 218.

The pulling chain 234 enters the tower 213 by passing under chain roller 235. The roller 235 can be adjusted vertically by placing the pin 236 in any of the vertical holes 237, 238, 239, 240, 241, 242, 243 or 244, thereby setting the height for the desired pull. The pin 236 is secured into one of the holes 237– 244 by means of clip 245.

The chain 234 is routed upwardly to the top roller 245 which is supported by plates 246 and 247, plate 246 being welded to the rear surface 232 of channel 226 and plate 247 being welded to the rear surface 233 of channel 227. Pin 248 passes through a hole (not shown) in plate 246, the roller 245 and the other plate 247, the pin 248 being secured by clip 249.

From roller 245 the chain 234 passes downwardly to arm 250 which pivots on pin 251 which is supported by a hole (not shown) in channels 226 and 227. The outer end 252 of arm 250 includes two plates 253 and 254 welded onto either side of arm 250, each plate 253 and 254 including a hole (not shown) which permits pin 255 to pass through both plates and the yoke 256 of the hydraulic cylinder 257 and secure the cylinder 257 to the arm 250. The yoke 258 on the opposite end of cylinder 257 is also mounted with a pin 259 which passes through each of two plates 260 and 261. Plate 260 is welded to the rear surface 232 of channel 226, while plate 261 is welded to the rear surface 233 of channel 227.

Figure 26:
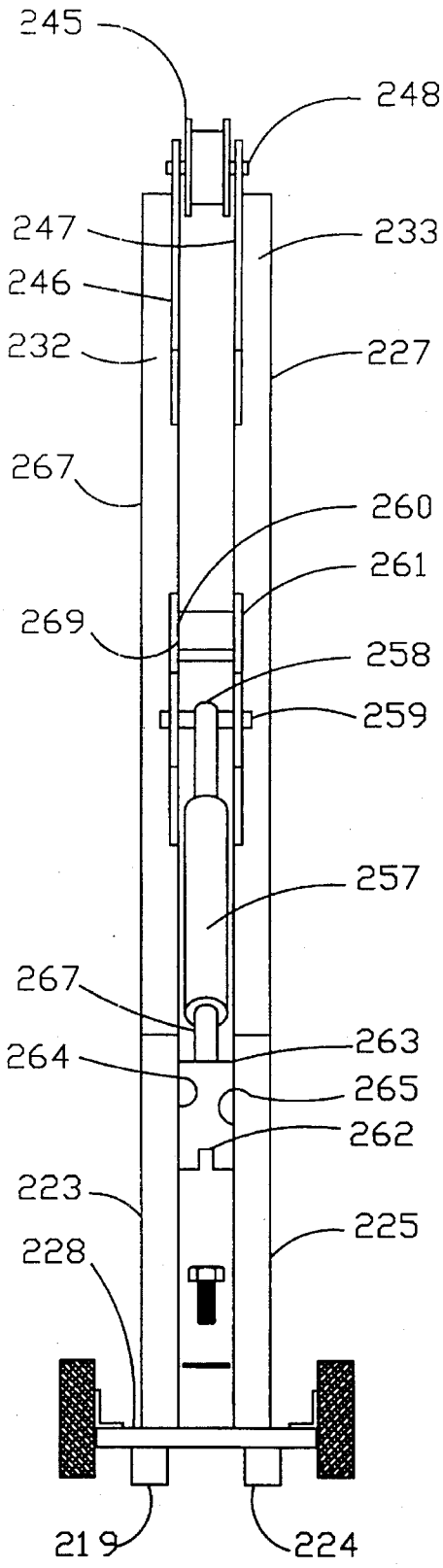
FIG. 26 is an end elevation of the pulling tower depicted in FIG. 24.
Figure 27:
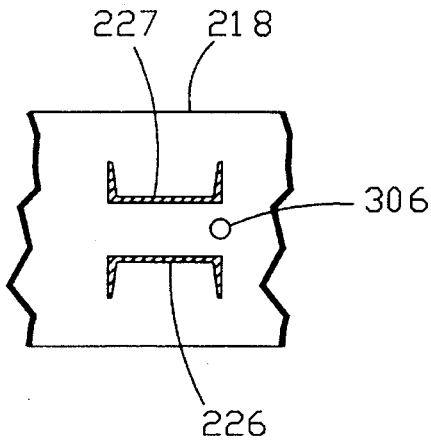
FIG. 27 is a sectional view taken along lines A—A of FIG. 25.
Figure 28:
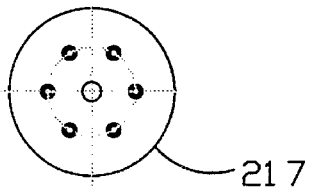
FIG. 28 is a plan view of an anchoring plate used in conjunction with the pulling tower depicted in FIG. 24.

The chain 234 is hooked in a notch 262 in plate 263 as seen in FIG. 26, the plate 263 being welded to the inside surfaces 264 and 265 of plate 253. The hydraulic cylinder 257 is operated with an air hydraulic pump 266. When the cylinder 257 is extended, the ram 267 pushes arm 250 in a downward direction, pulling chain 234 under roller 235, up to roller 245 and downward to so as to pull the damaged vehicle 124 back to its original shape. A plate 268 is welded to the upper surfaces of channels 226 and 227 and plate 269 is welded to the inside portions of plate 260 in order to stabilize the two channels 226 and 227 and prevent them from being displaced relative to each other during a pulling operation. A safety chain (not shown) is also attached to the pulling tower 213 and attached to a suitable anchor (not shown) to secure the tower 213 during pulling operations.

Figure 29:
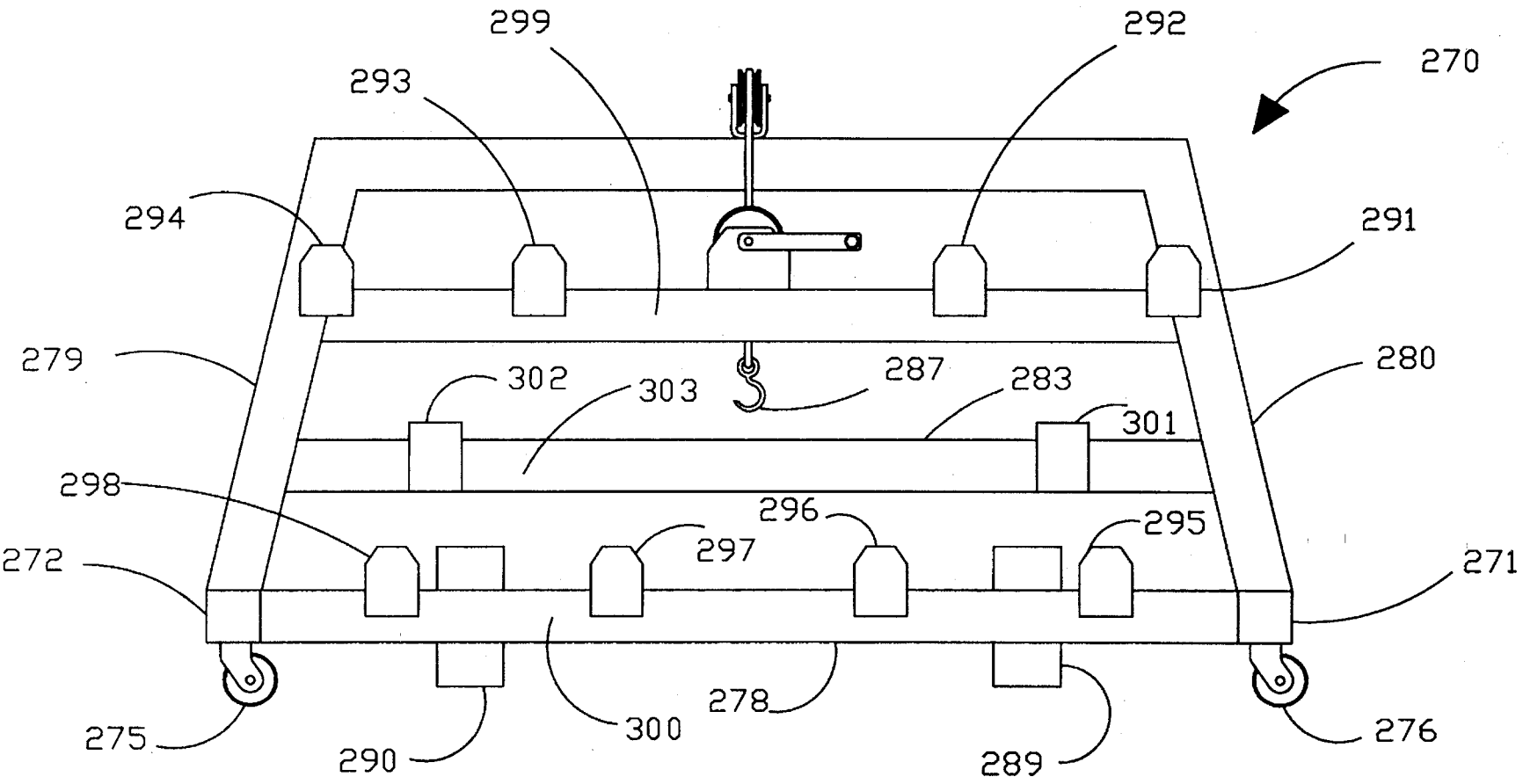
FIG. 29 is a rear elevation of a cart constructed in accordance with the principles of the present invention.
Figure 30:
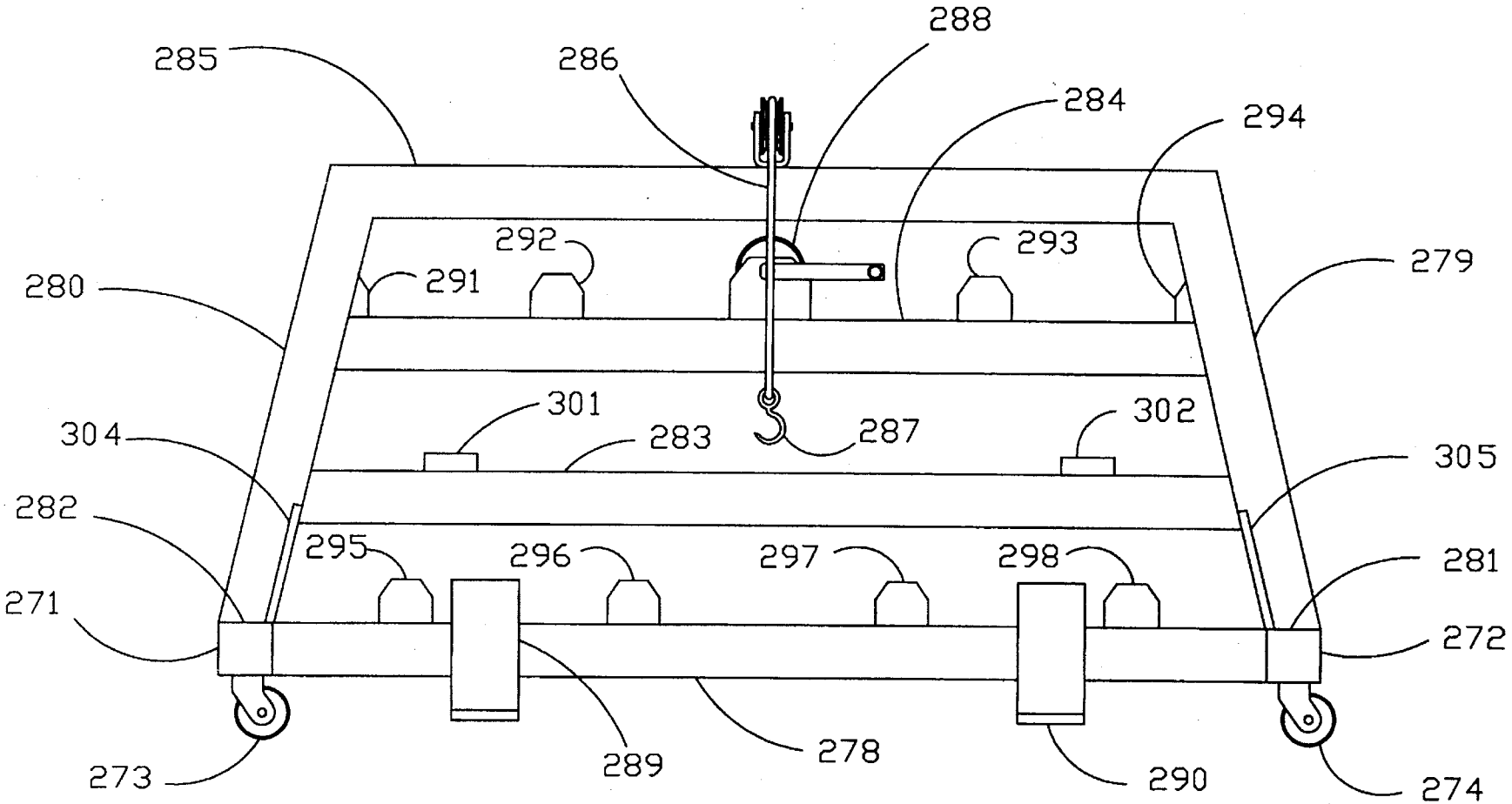
FIG. 30 is a front elevation of the cart depicted in FIG. 29.
Figure 31:
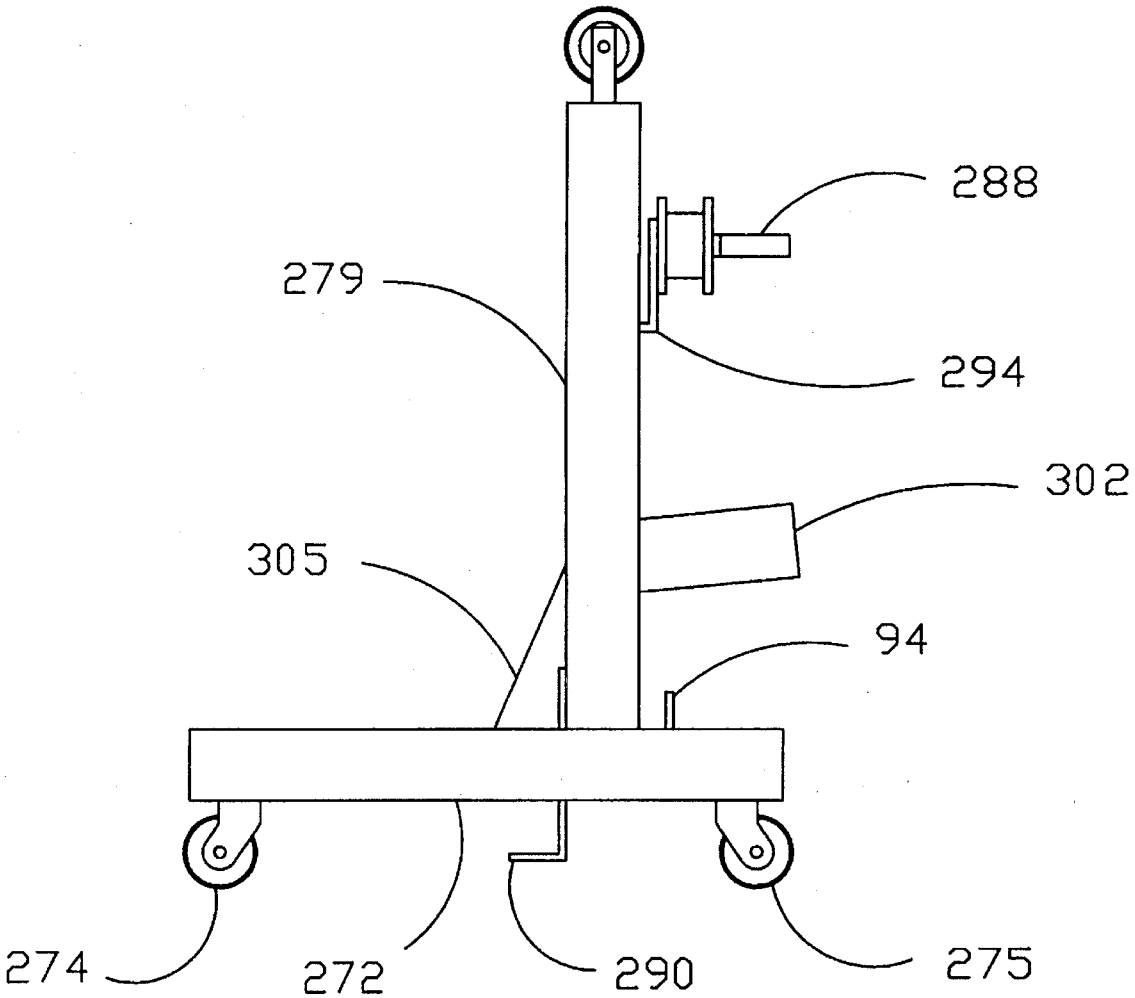
FIG. 31 is a side elevation of the cart depicted in FIG. 29.

In order to make the assembly 1 portable, a cart 270 was designed as shown in FIGS. 29, 30 and 31. The bottom legs 271 and 272 are preferably constructed from square steel tubing with swivel casters 273, 274, 275 and 276 mounted on each end of each leg. The legs 271 and 272 are connected together by means of cross braces 278 being welded to each leg.

Uprights 279 and 280 are welded at an angle to the top surface 281 and 282, respectively, of each leg with square steel tubing cross braces 283, 284 and 285 being welded to the uprights 279 and 280. The cart 270 can be positioned next to the assembly 1 with legs 271 and 272 straddling ends 6 and 16 of the assembly 1. After the center bolt 107 is removed, a cable 286 and hook plate 287 can be fastened to the opposite side beam 9 of assembly 1 and cranked upwardly with winch 288 so as to stand or tip the assembly 1 onto support pads 289 and 290.

The cart 270 is also furnished with eight brackets 291, 292, 293, 294, 295, 296, 297 and 298, as seen in FIGS. 29 and 31, which are formed of steel sheets or plates bent at a ninety degree angle and welded to the rear surfaces 299 and 300 of crossmembers 278 and 284 in order to provide a place to store the four pinchweld clamps 125, 126, 127 and 128 and the four full frame clamps such as clamp 173 as illustrated in FIGS. 20 and 21.

Two square tubes 301 and 302 are welded to the rear side 303 of crossbrace 283 in order to provide a storage place for beams 32 and 33. The upright portion 279 of the cart 270 is stabilized by flat triangular pieces of metal 304 and 305 welded to legs 271 and 272, respectively and upright members 279 and 280.

While preferred embodiments of the present invention have been described hereinabove, it is intended that all matter contained in the above description and shown in the accompanying drawings be interpreted as illustrative and not in a limiting sense, and that all modifications, constructions and arrangements which fall within the scope and spirit of the invention may be recognized as part of the present invention.

I claim:

1. A portable vehicle frame straightening device, comprising:

(a) a rotatable carriage, the rotatable carriage being pivotably affixed to a single anchor by a centrally located spindle, the vehicle being affixed to the carriage;

(b) a first chain, the first chain having a first end and a second end, the first end being attachable to the vehicle;

(c) a tower, the second end of the first chain being affixed to the tower, the tower including a plurality of wheels, the wheels thereby permitting the tower to be rolled across a floor;

(d) a cart, the cart being adapted to receive components of the rotatable carriage, the cart including a plurality of wheels, the cart thereby permitting storage and relocation of the rotatable carriage;

(e) four chain retaining members, each of the four chain retaining members being affixed to the rotatable carriage; and (f) a second chain, the second chain having a first end a second end, the first end of the second chain being affixed to a single anchor site, the second end of the chain being affixed to one of the four chain retaining members, the second chain thereby preventing rotation of the rotatable carriage when a tensile force is applied to the first chain.

2. The portable frame straightening device of claim 1, further comprising a plurality of vehicle securing clamps, the vehicle securing clamps being secured to and repositionable on the rotatable carriage, thereby permitting accommodation of vehicles having different dimensions.

3. The portable frame straightening device of claim 2, wherein the rotatable carriage comprises:

(a) first and second lateral members; and (b) first and second longitudinal members, the longitudinal members having a length, the longitudinal members being rigidly affixed to the lateral members so as to form a substantially rectangular framework.

4. The portable frame straightening device of claim 3, further comprising first and second vehicle clamp supporting members, each vehicle clamp supporting member being adjustably mounted to the first and second longitudinal members, the vehicle clamp supporting members being substantially parallel to the first and second lateral members.

5. The portable frame straightening device of claim 4, wherein each vehicle securing clamp is slidably mounted to a vehicle clamp supporting member, each vehicle securing clamp being adjustable in a direction parallel to the vehicle clamp supporting member.

6. The portable frame straightening device of claim 5, wherein the tower has a height, the height being greater than the length of the longitudinal members, thereby permitting application of a tensile force via the first chain throughout three hundred sixty degrees of azimuth and substantially one hundred eighty degrees of elevation.

7. A method of straightening a damaged vehicle frame, comprising the steps of:

(a) securing a framework to a rotatable spindle;

(b) mounting the vehicle on the framework;

(c) mounting a rotatable tower away from the framework;

(d) affixing a first end of a first cable to the damaged vehicle frame;

(e) affixing a second end of the first cable to the tower;

(f) applying a tensile force to the first cable so as to straighten the vehicle frame;

(g) affixing a single cable between the framework and a single anchor site so as to prevent rotation of the framework when a tensile force is applied to the first cable;

(h) rotating the framework and the rotatable tower so as to permit application of a tensile force along a desired vector, thereby eliminating multiple applications of a tensile force to the damaged vehicle frame in order to accomplish a desired repair;

(i) securing a first end of a second cable to the tower and securing the second end of the second cable to an anchor, thereby securing the tower to a defined region when another securing component of the tower fails; and (j) removing the framework from the rotatable spindle and mounting the framework on a movable cart, thereby permitting relocation of the framework after the damaged vehicle is repaired.

* * * * *